US006375539B1

(12) United States Patent
Sudo et al.

(10) Patent No.: US 6,375,539 B1
(45) Date of Patent: Apr. 23, 2002

(54) LAPPING MACHINE, LAPPING METHOD, AND ROW TOOL

(75) Inventors: Koji Sudo; Yoshiaki Yanagida, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/911,815

(22) Filed: Jul. 24, 2001

(30) Foreign Application Priority Data

Oct. 27, 2000 (JP) ..... 2000-328734

(51) Int. Cl.[7] ..... B24B 49/00

(52) U.S. Cl. ..... 451/5; 451/41; 451/232; 451/272; 451/278; 451/279; 451/366

(58) Field of Search ..... 451/5, 41, 232, 451/272, 278, 279, 366

(56) References Cited

U.S. PATENT DOCUMENTS 5,023,991 A 6/1991 Smith
5,607,340 A * 3/1997 Lackey et al. ..... 451/5
5,607,346 A 3/1997 Wilson et al.
6,074,283 A * 6/2000 Maeda et al. ..... 451/53
6,315,636 B1 * 11/2001 Yanagida et al. ..... 451/11

FOREIGN PATENT DOCUMENTS

JP 5-123960 5/1993

* cited by examiner

*Primary Examiner*—Joseph J. Hail, III
*Assistant Examiner*—Shantese McDonald
(74) *Attorney, Agent, or Firm*—Greer, Burns & Crain, Ltd.

(57) ABSTRACT

A lapping machine for lapping a row bar includes a lap plate for providing a lapping surface, a row tool having a plurality of bend cells formed by defining a plurality of slits, a pressure mechanism for pressing the row tool toward the lapping surface of the lap plate, and a bend mechanism for bending the bend cells of the row tool toward the lapping surface of the lap plate. The bend mechanism includes an air cylinder unit having a plurality of double-acting air cylinders, a plurality of racks operatively connected to the double-acting air cylinders, respectively, a plurality of drive pinions arranged coaxially and meshing with the racks, respectively, each drive pinion having a lever for driving the corresponding bend cell, a plurality of support pinions arranged coaxially and meshing with the racks, respectively, and a guide mechanism for guiding each rack, the respective drive pinion, and the respective support pinion in substantially the same plane.

12 Claims, 15 Drawing Sheets

LAPPING MACHINE, LAPPING METHOD, AND ROW TOOL

BACKGROUND OF THE INVENTION

1. Field of the Invention

The present invention relates to a lapping machine for lapping a row bar formed with a plurality of head elements arranged in a line, and a lapping method for lapping such a row bar.

2. Description of the Related Art

In a manufacturing process for a magnetic head slider, for example, a magnetic head thin film is formed on a substrate and next subjected to lapping, thereby making constant the heights of a magnetoresistive layer and a gap in the magnetic head thin film. The heights of the magnetoresistive layer and the gap are required to have an accuracy on the order of submicrons. Accordingly, a lapping machine for lapping a row bar as a workpiece is also required to have a high accuracy. Thus, the magnetic head slider is lapped so that the height of the magnetoresistive film becomes constant. However, the row bar is very thin, and its thickness is about 0.3 mm, for example.

Accordingly, it is difficult to lap the row bar directly by the lapping machine, and the row bar is therefore bonded to a row tool before lapping. That is, the row bar bonded to the row tool is pressed on a lap plate during lapping. As known from U.S. Pat. No. 5,023,991 and Japanese Patent Laid-open. No. Hei 5-123960, for example, the resistances of electrical lapping guide elements (ELG elements) formed integrally with the row bar are always measured during lapping. Then, whether or not the height of the magnetoresistive film of each magnetic head element has become a target height is detected according to the measured resistance of each ELG element. When it is detected that the magnetoresistive film has been lapped up to the target height, according to the measured resistance, the lapping operation is stopped.

Thereafter, the lapped surface of the row bar is formed into the shapes of flying surfaces of a plurality of magnetic head sliders, and the row bar is next cut into the plurality of magnetic head sliders in the condition that it is bonded to the row tool. Thereafter, the row tool is heated to melt an adhesive bonding the row bar to the row tool, thereby removing the magnetic head sliders from the row tool to obtain the individual magnetic head sliders. In this manner, a wafer is cut into a plurality of row bars each having the plural magnetic head elements arranged in a line, and each row bar is subjected to lapping by using the row tool. Accordingly, the magnetoresistive films of the plural magnetic head elements can be lapped at a time.

However, there are variations in height among the magnetoresistive films of the plural magnetic head elements in the row bar on the order of submicrons, depending on the accuracy of film deposition of the magnetoresistive films, the accuracy of bonding of the row bar to the row tool, etc. It is accordingly necessary to correct for such variations in the lapping operation for mass production of magnetic head sliders uniform in characteristics. There have been proposed various conventional methods for correcting for the above-mentioned variations on the order of submicrons in the lapping operation. For example, U.S. Pat. No. 5,607,346 has proposed a method such that a plurality of holes are formed through the row tool and forces are applied from actuators through these holes to the row tool.

However, these actuators are required to have capacities of applying relatively large forces to these holes, in order to obtain a desired pressure distribution, and it is therefore difficult to manufacture such actuators acting on a plurality of load points. As a result, the spacing between any adjacent ones of the plural load points (the plural holes) cannot be greatly reduced, causing a difficulty of improvement in lapping accuracy.

SUMMARY OF THE INVENTION

It is therefore an object of the present invention to provide a lapping machine and a lapping method which can improve the accuracy of lapping of a row bar formed with a plurality of head elements arranged in a line.

In accordance with an aspect of the present invention, there is provided a lapping machine for lapping a row bar formed with a plurality of head elements arranged in a line, comprising a lap plate for providing a lapping surface; a row tool having a plurality of bend cells formed by defining a plurality of slits; a pressure mechanism for pressing the row tool toward the lapping surface of the lap plate; and a bend mechanism for bending the bend cells of the row tool toward the lapping surface of the lap plate; the bend mechanism comprising an air cylinder unit having a plurality of double-acting air cylinders; a plurality of racks operatively connected to the double-acting air cylinders, respectively; a plurality of first pinions arranged coaxially and meshing with the racks, respectively, each of the first pinions being integrally formed with a lever; a plurality of second pinions arranged coaxially and meshing with the racks, respectively, the second pinions being spaced apart from the first pinions; and a guide mechanism for guiding each of the racks, the respective first pinion, and the respective second pinion in substantially the same plane; each of the bend cells of the row tool having an engaging hole for engaging a front end of each lever, whereby each lever engaged with the engaging hole is rotated to bend each bend cell of the row tool toward the lapping surface of the lap plate.

Preferably, the bend mechanism further comprises a plurality of electro-pneumatic conversion regulators connected to the double-acting air cylinders, respectively; and a compressed air source connected to the electro-pneumatic conversion regulators. Preferably, the row tool further has first and second ends between which the bend cells are formed; a pair of fixed cells formed at the first and second ends, each of the fixed cells having a width larger than that of each bend cell; and a parallel spring mechanism formed by defining a through hole extending from the first end to the second end.

Preferably, the guide mechanism comprises a rack guide having a plurality of guide gaps for guiding the racks, respectively; each of the racks has a first surface formed with a gear and a second surface formed with a projection opposite to the first surface, the projection being in contact with the rack guide; and each of the racks is supported at a first point of contact with the respective first pinion, a second point of contact with the respective second pinion, and a third point of contact with the rack guide at the projection, whereby each rack is linearly reciprocated in a horizontal direction.

In accordance with another aspect of the present invention, there is provided a bend mechanism for locally bending a row bar formed with a plurality of head elements arranged in a line, comprising a plurality of racks arranged in a direction perpendicular to a direction of movement of the racks; and a plurality of first pinions arranged coaxially and meshing with the racks, respectively, each of the first pinions being integrally formed with a lever.

Preferably, the bend mechanism further comprises an air cylinder unit having a plurality of double-acting air cylinders, each of the double-acting air cylinders having a piston and a piston rod connected to the piston; a plurality of second pinions arranged coaxially and meshing with the racks, respectively, the second pinions being spaced apart from the first pinions; and a guide mechanism for guiding each of the racks, the respective first pinion, and the respective second pinion in substantially the same plane; the racks being connected to the piston rods of the double-acting air cylinders, respectively.

Preferably, the guide mechanism comprises a rack guide having a plurality of first guide gaps, and a pinion guide having a plurality of second guide gaps; the racks being guided in the first guide gaps of the rack guide, respectively; the first and second pinions being guided in the second guide gaps of the pinion guide, respectively.

In accordance with a further aspect of the present invention, there is provided a lapping method for lapping a row bar formed with a plurality of head elements arranged in a line, comprising the steps of providing a lapping surface by a lap plate; bonding the row bar to a lower surface of a row tool having a plurality of bend cells formed by defining a plurality of slits; pressing the row bar on the lapping surface; and operating a bend mechanism including an air cylinder unit having a plurality of double-acting air cylinders, a plurality of racks operatively connected to the double-acting air cylinders, respectively, and a plurality of pinions arranged coaxially and meshing with the racks, respectively, each of the pinions being integrally formed with a lever, thereby applying an adjustable bending pressure to each of the bend cells; whereby the row bar is bent at a plurality of points to perform lapping of the row bar.

In accordance with a still further aspect of the present invention, there is provided a row tool to which a row bar formed with a plurality of head elements arranged in a line is to be bonded, comprising a plurality of bend cells formed by defining a plurality of slits, each of the bend cells having an engaging hole; first and second ends between which the bend cells are formed; a pair of fixed cells formed at the first and second ends, each of the fixed cells having a width larger than that of each bend cell; and a parallel spring mechanism formed by defining a through hole extending from the first end to the second end.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
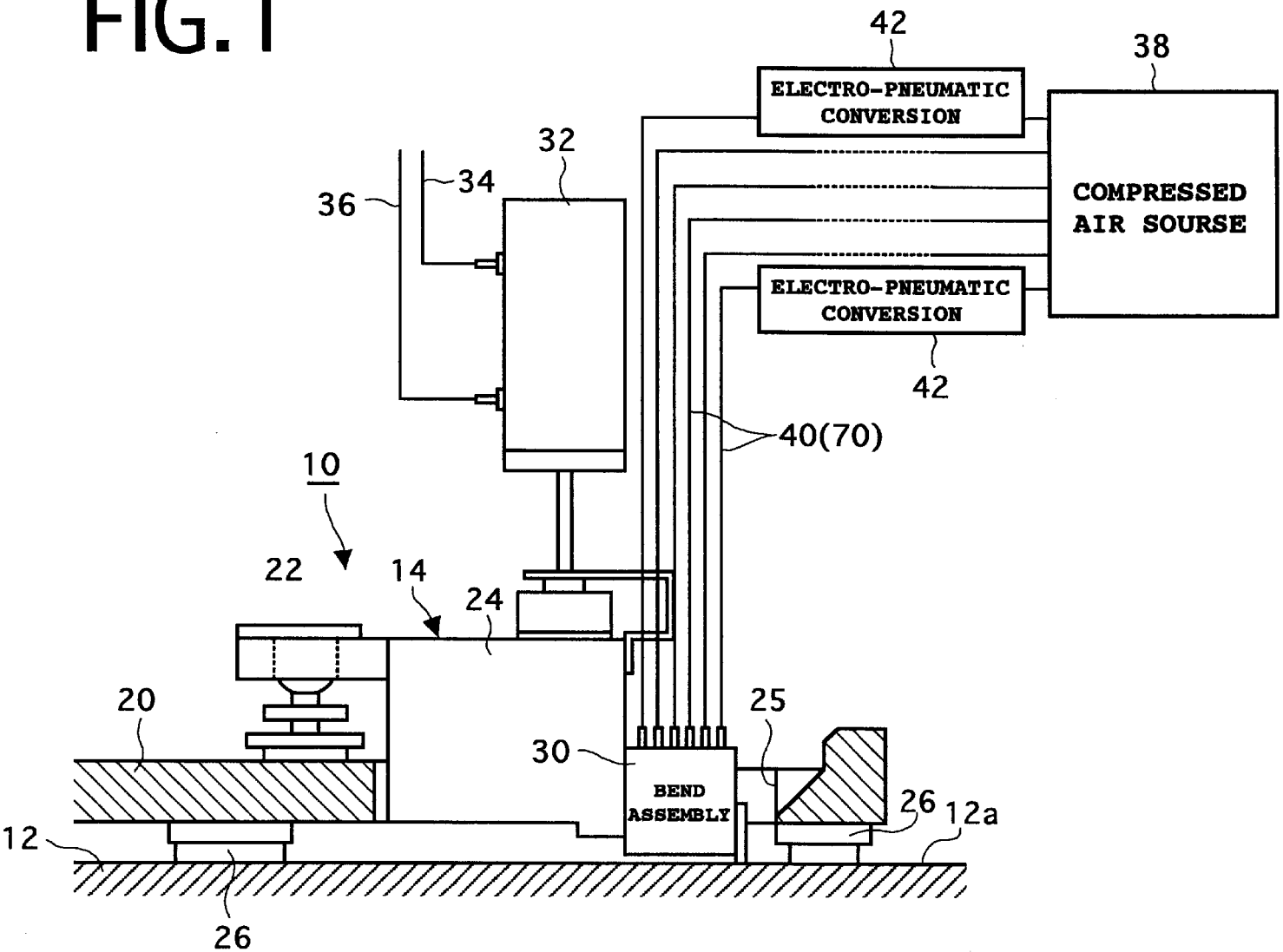
FIG. 1 is a vertical sectional view of a lapping machine.
Figure 2:
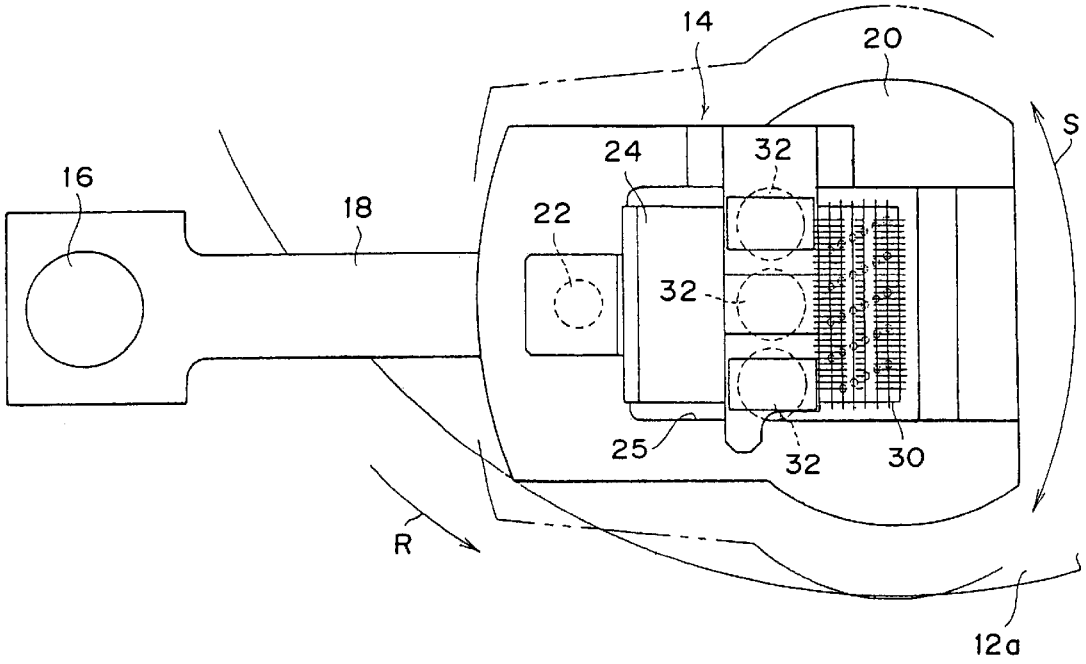
FIG. 2 is a plan view of the lapping machine.

A preferred embodiment of the present invention will now be described in detail with reference to the drawings. Referring to FIG. 1, there is shown a sectional view of a lapping machine 10. FIG. 2 is a plan view of the lapping machine 10. The lapping machine 10 is composed of a lap plate 12 for providing a lapping surface 12*a*, and a lap unit 14. The lap unit 14 includes a lap base 20 pivotably supported through an arm 18 to a pivot shaft 16, and a lap head 24 supported relatively movably to the lap base 20 by a ball joint 22 fixed to the lap base 20.

The lap base 20 has an opening 25, and the lap head 24 is inserted in the opening 25. A plurality of (e.g., four) feet 26 are provided on the lower surface of the lap base 20. The feet 26 slide on the lapping surface 12*a*. A bend assembly 30 to be hereinafter described in detail is fixed to the lap head 24 by means of screws or the like. Three pneumatic cylinders 32 for applying pressure to the lap head 24 are provided above the lap head 24. Each pneumatic cylinder 32 is connected through pipes 34 and 36 to an electro-pneumatic conversion regulator (not shown) and a compressed air source 38.

The bend assembly 30 includes an air cylinder unit having a plurality of double-acting air cylinders to be hereinafter described. Each double-acting air cylinder is connected through an air tube 40 to an electro-pneumatic conversion regulator 42. Each electro-pneumatic conversion regulator 42 is connected to the compressed air source 38. The bend assembly 30 further includes a row tool to be hereinafter described. In lapping a row bar bonded to the row tool, the lap plate 12 is rotated in a direction of arrow R shown in FIG. 2 by a motor (not shown), and the lap unit 14 is swung in opposite directions of arrow S shown in FIG. 2 about the pivot shaft 16 by a drive mechanism (not shown). The lap plate 12 is rotated at about 50 rpm during rough lapping and at about 15 rpm during finish lapping. On the other hand, the lap unit 14 is swung at about 10 cycles per minute both during rough lapping and during finish lapping.

Figure 3:
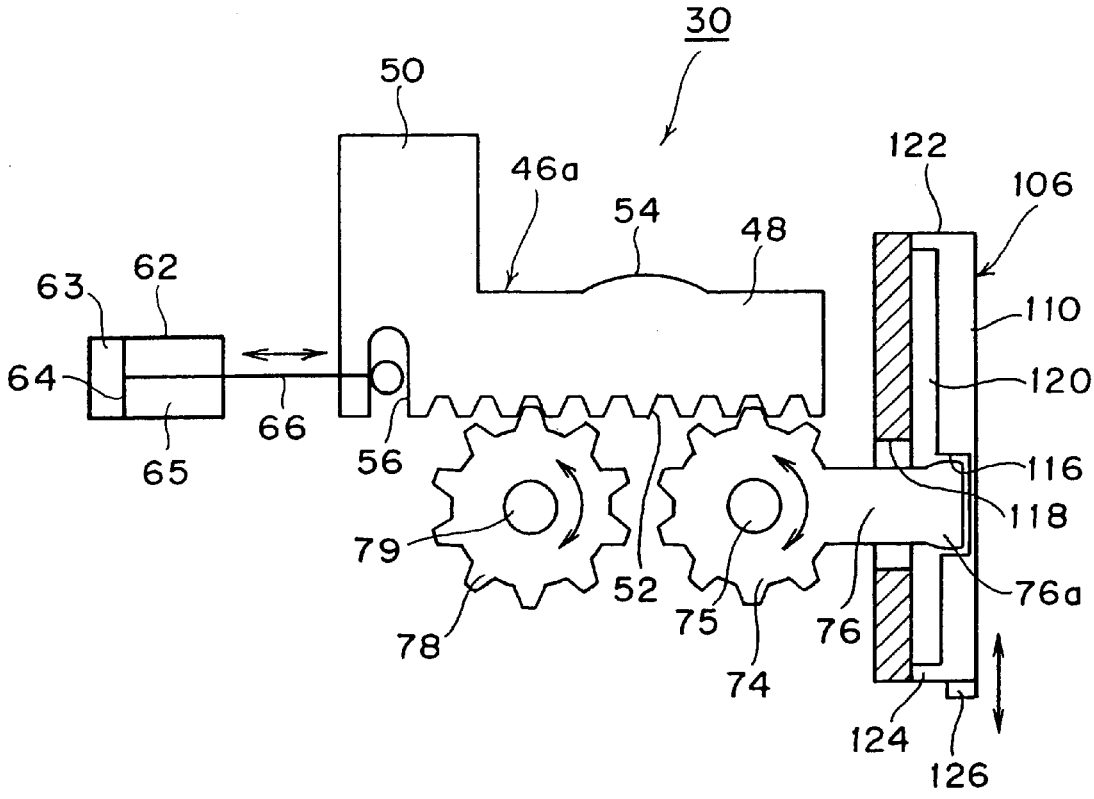
FIG. 3 is a schematic view for illustrating the principle of operation of a bend assembly.

Referring to FIG. 3, there is shown a schematic view for illustrating the principle of operation of the bend assembly 30. Reference numeral 46*a* denotes a rack having a body portion 48 and a head portion 50 formed integrally with the body portion 48. A gear 52 is formed on the lower surface of the body portion 48, and an arcuate projection 54 is formed on the upper surface of the body portion 48. The head portion 50 is formed with an engaging hole 56. The rack 46*a* is reciprocated by a double-acting air cylinder 62. The double-acting air cylinder 62 is included in an air cylinder unit 58 shown in FIG. 4. The air cylinder unit 58 has a cylinder housing 60, and a plurality of (e.g., 28) double-acting air cylinders 62 are defined in the cylinder housing 60. Each air cylinder 62 has a piston 64 and a piston rod 66 connected to the piston 64, whereby a head-side chamber 63 and a rod-side chamber 65 are defined in the air cylinder 62. The piston rod 66 is connected to the rack 46*a*. Each air cylinder 62 has a bore of 2.5 mm, and the piston rod 66 has a diameter of 1 mm.

Figure 14:
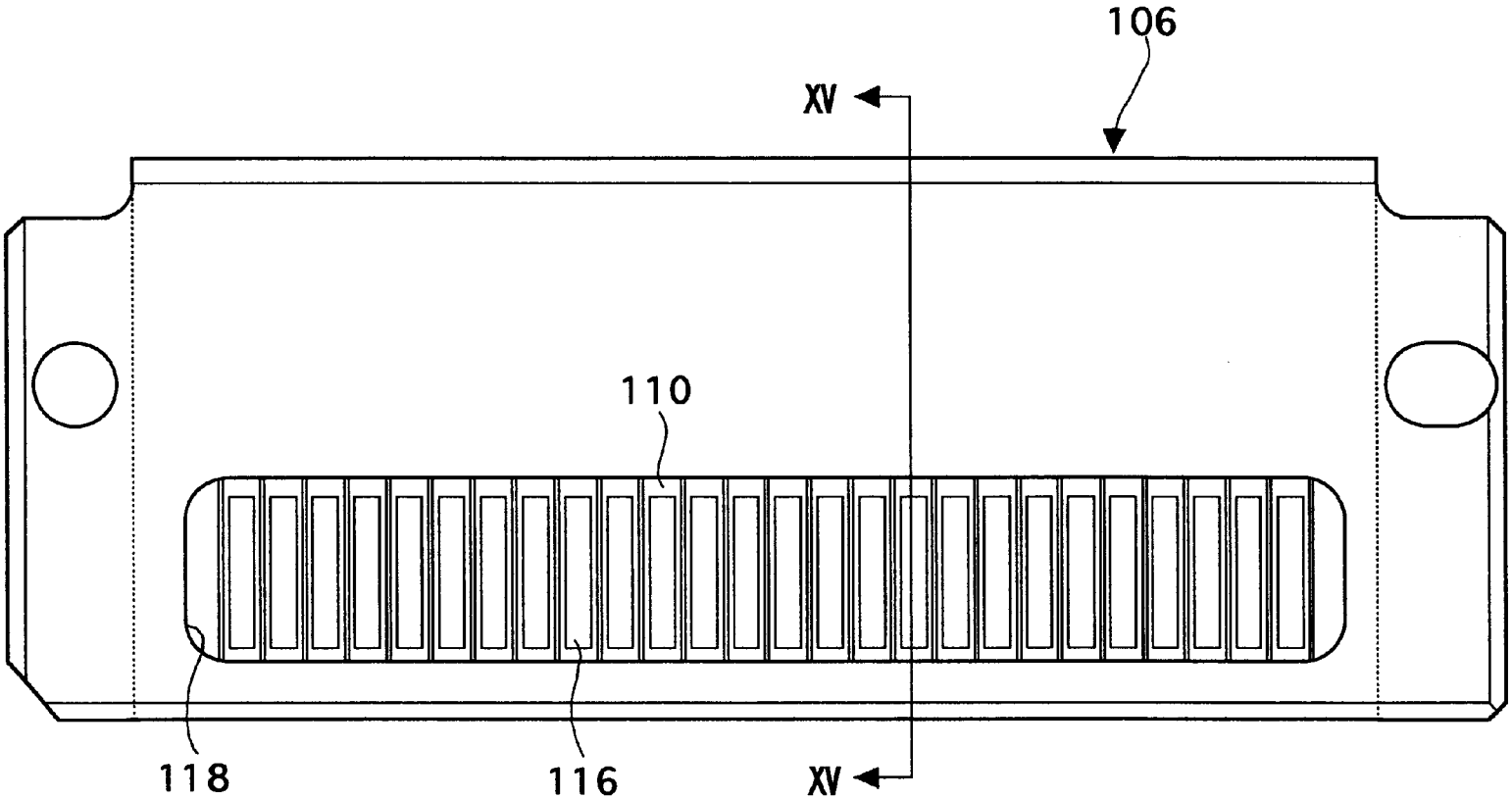
FIG. 14 is a rear elevation of the row tool.

The structure of the air cylinder unit 58 will now be described with reference to FIGS. 4 and 5A to 5C. The double-acting air cylinders 62 are zigzag arranged in the cylinder housing 60 so as to form a 4×7 parallelogram lattice as viewed in elevation. The piston rods 66 project from the front surface of the cylinder housing 60 in such a manner that seven piston rods 66 are aligned in each of rows a, b, c, and d. As shown in FIG. 5A, 14 pull ports 68 respectively corresponding to the piston rods 66 arranged in the rows a and b open to the upper surface of the cylinder housing 60 in such a manner that seven pull ports 68 are aligned in each of the rows a and b. Each pull port 68 communicates with the rod-side chamber 65 of the corresponding air cylinder 62. Although not shown, 14 pull ports respectively corresponding to the piston rods 66 arranged in the rows c and d open to the lower surface of the cylinder housing 60 like the pull ports 68.

Figure 4:
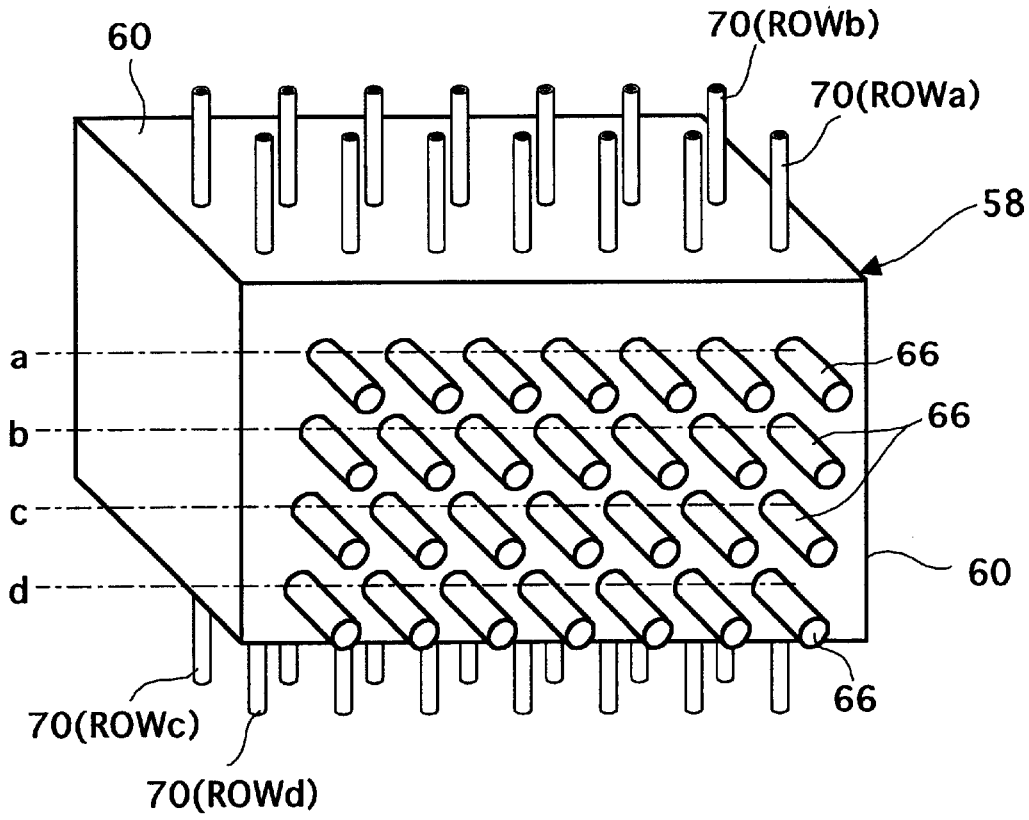
FIG. 4 is a perspective view of an air cylinder unit.
Figure 5A:
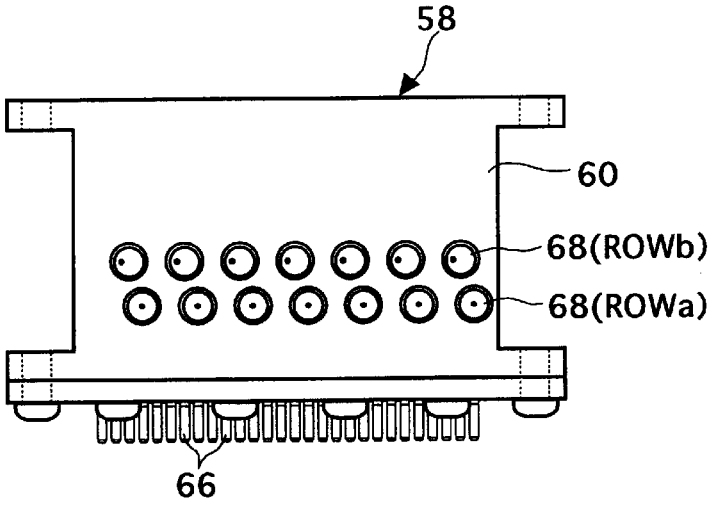
FIG. 5A is a plan view of the air cylinder unit.
Figure 5B:
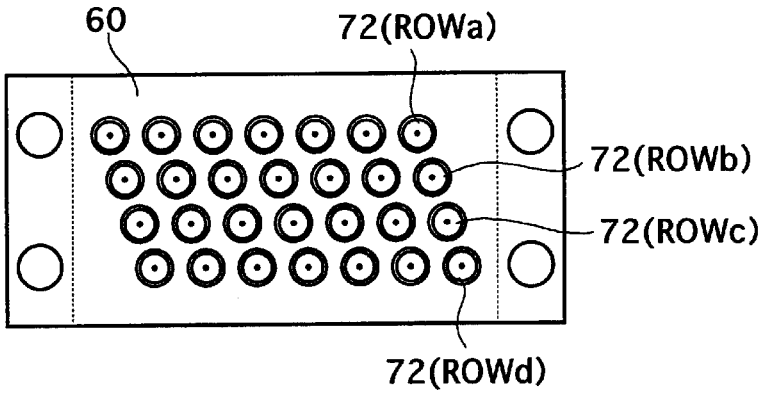
FIG. 5B is a rear elevation of the air cylinder unit.
Figure 5C:
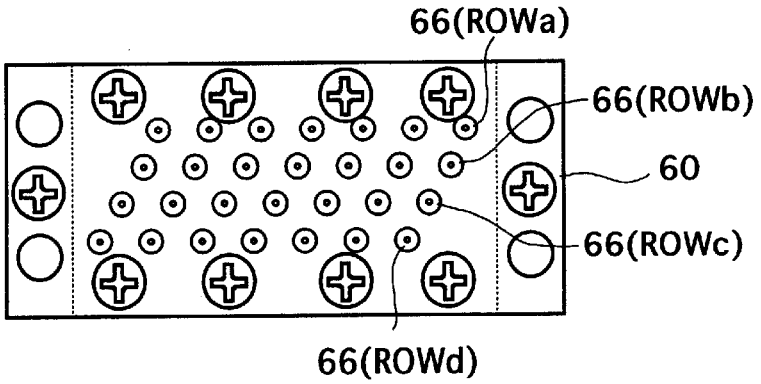
FIG. 5C is a front elevation of the air cylinder unit.

The pull ports 68 for the piston rods 66 arranged in the rows a and b are connected to upward extending air tubes 70 shown in FIG. 4, respectively. Similarly, the pull ports for the piston rods 66 arranged in the rows c and d are connected to downward extending air tubes 70 shown in FIG. 4, respectively. Further, as shown in FIG. 5B, 28 push ports 72 respectively corresponding to the piston rods 66 arranged in the rows a, b, c, and d open to the rear surface of the cylinder housing 60 in such a manner that seven push ports 72 are aligned in each of the rows a, b, c, and d. Each push port 72 communicates with the head-side chamber 63 of the corresponding air cylinder 62. Although not shown, all of the push ports 72 are connected to air tubes, respectively. The air tubes 70 for the pull ports 68 and the air tubes for the push ports 72 are connected to the electro-pneumatic conversion regulators 42 shown in FIG. 1, respectively.

Referring again to FIG. 3, a drive pinion 74 integrally formed with a lever 76 meshes with the gear 52 of the rack 46*a*. The drive pinion 74 has a central mounting hole 75. Similarly, a support pinion 78 meshes with the gear 52 of the rack 46*a*. The support pinion 78 has a central mounting hole 79, and is arranged so as to prevent lowering of the rack 46*a* and to allow a linear reciprocating motion of the rack 46*a*.

Figure 6:
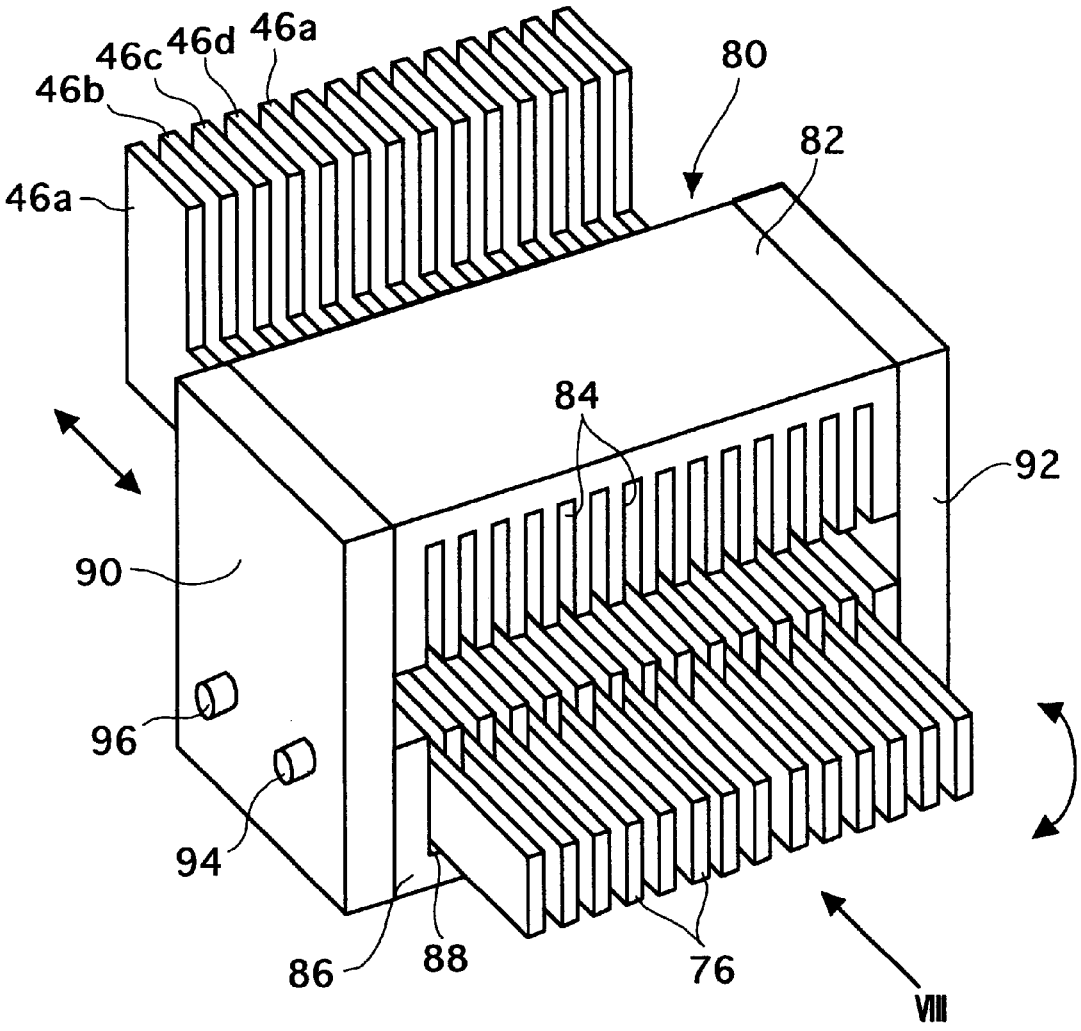
FIG. 6 is a perspective view of a bend unit.

Referring to FIG. 6, there is shown a perspective view of a bend unit 80. The bend unit 80 includes a rack guide 82 having a plurality of first guide gaps 84, and a pinion guide 86 having a plurality of second guide gaps 88. The rack guide 82 and the pinion guide 86 are fixed to a pair of side plates 90 and 92. A shaft 94 extends over the side plate 90, the pinion guide 86, and the side plate 92. The shaft 94 is inserted through the mounting holes 75 of a plurality of drive pinions 74 to rotatably support these drive pinions 74. Similarly, a shaft 96 extends over the side plate 90, the pinion guide 86, and the side plate 92. The shaft 96 is inserted through the mounting holes 79 of a plurality of support pinions 78 to rotatably support these support pinions 78.

A plurality of racks 46*a*, 46*b*, 46*c*, and 46*d* respectively shown in FIGS. 7A, 7B, 7C, and 7D are inserted in the first guide gaps 84 of the rack guide 82 sequentially and cyclically. These racks 46*a* to 46*d* are different in height of the engaging hole 56 from the gear 52, and the other configuration is the same as each other. Each of the racks 46*a* to 46*d* has a thickness of 0.6 mm. Further, each drive pinion 74 has a thickness of 0.4 mm, and each support pinion 78 has a thickness of 0.4 mm.

The thicknesses of each of the racks 46*a* to 46*d*, each drive pinion 74, and each support pinion 78 are preferably set in the range of ¼ to ½ of the pitch of bend cells of the row tool to be hereinafter described in detail. Further, the gear module of each of the racks 46*a* to 46*d*, each drive pinion 74, and each support pinion 78 is preferably set to ½ or less of the pitch of the bend cells. More preferably, this gear module is set to 0.1 to 0.3 times the pitch of the bend cells.

Figure 7A:
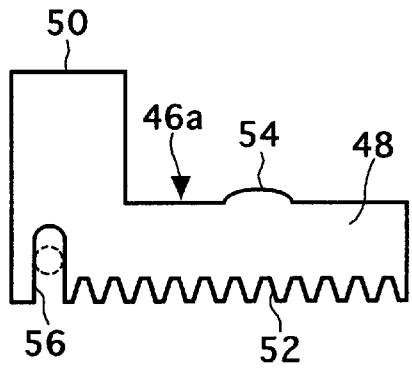
FIGS. 7A to 7D are side views showing four kinds of rack shapes used in the present invention.
Figure 7B:
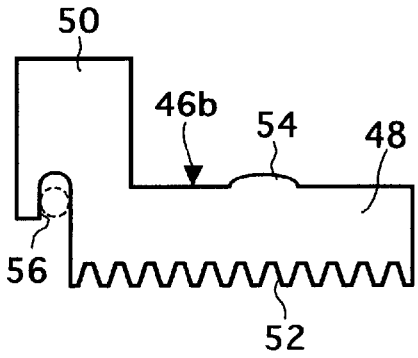
Figure 7C:
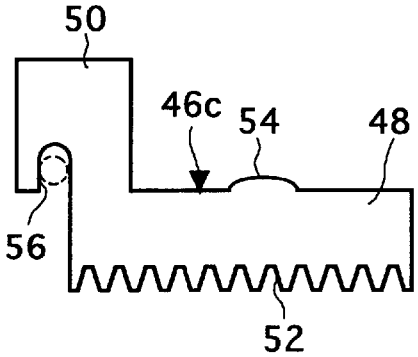
Figure 7D:
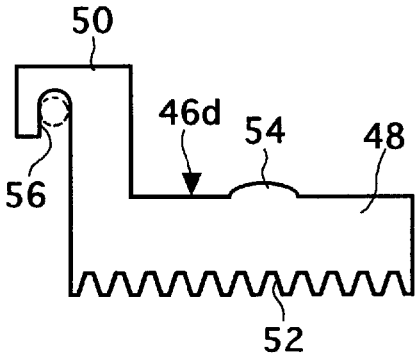

The racks 46*a* shown in FIG. 7A are connected to the piston rods 66 arranged in the row d in the air cylinder unit 58 shown in FIG. 4. The racks 46*b* shown in FIG. 7B are connected to the piston rods 66 arranged in the row c in the air cylinder unit 58 shown in FIG. 4. The racks 46*c* shown in FIG. 7C are connected to the piston rods 66 arranged in the row b in the air cylinder unit 58 shown in FIG. 4. The racks 46*d* shown in FIG. 7D are connected to the piston rods 66 arranged in the row a in the air cylinder unit 58 shown in FIG. 4.

Figure 8:
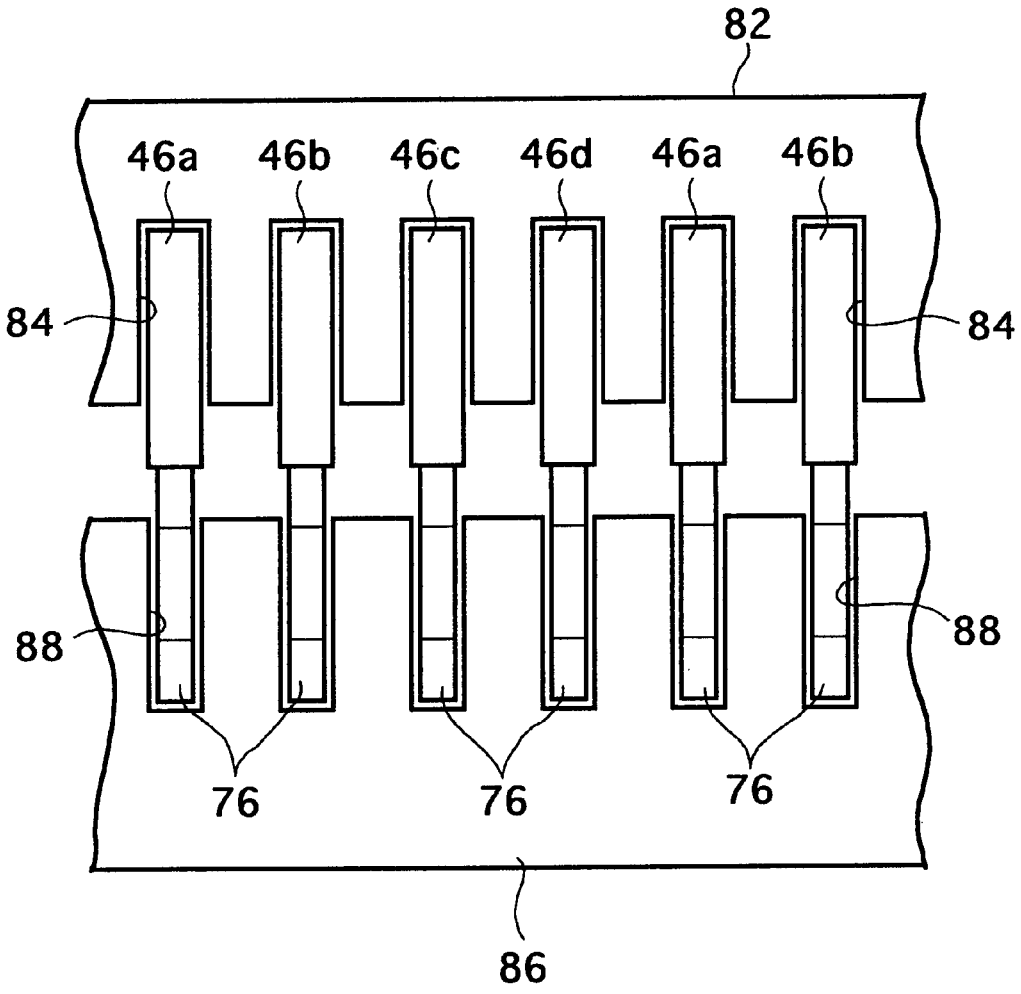
FIG. 8 is a view taken in the direction of arrow VIII in FIG. 6.

FIG. 8 is a view taken in the direction of arrow VIII in FIG. 6. Each of the racks 46*a* to 46*d* has a thickness of 0.6 mm as mentioned above, so that each first guide gap 84 of the rack guide 82 has a width slightly larger than 0.6 mm. Further, each drive pinion 74 has a thickness of 0.4 mm, and each support pinion 78 has a thickness of 0.4 mm as mentioned above, so that each second guide gap 88 of the pinion guide 86 has a width slightly larger than 0.4 mm.

Further, the pitch of the first guide gaps 84 of the rack guide 82 is the same as the pitch of the second guide gaps 88 of the pinion guide 86. The racks 46*a* to 46*d*, the drive pinions 74, and the support pinions 78 are formed of stainless steel, and surface-treated to have wear resistance. The shafts 94 and 96 for rotatably supporting the drive pinions 74 and the support pinions 78 are also formed of stainless steel quenched to improve hardness.

Figure 9A:
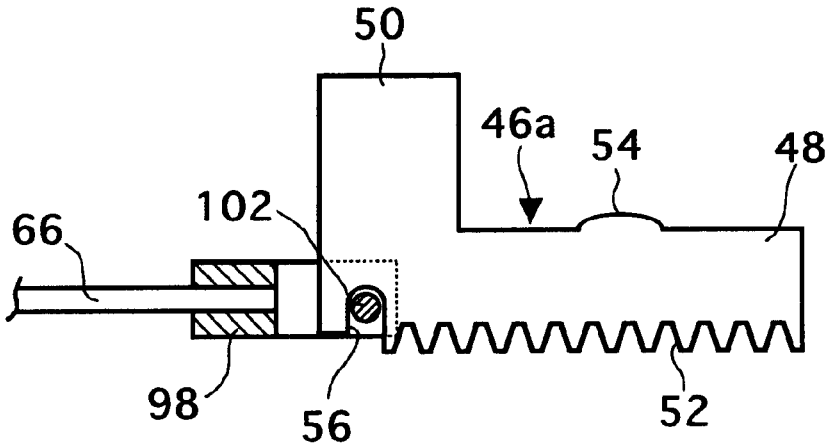
FIG. 9A is a partially sectional, side view showing a connection structure between a piston rod and a rack.
Figure 9B:
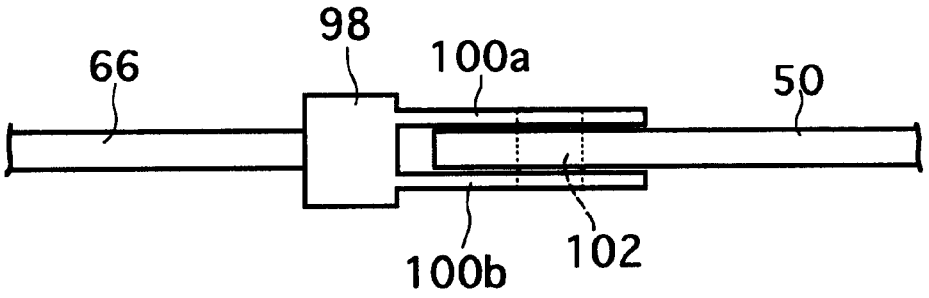
FIG. 9B is a plan view of the connection structure shown in FIG. 9A.

Referring to FIG. 9A, there is shown a partially sectional, side view showing a connection structure between the piston rod 66 and the rack 46*a*. FIG. 9B is a plan view of the connection structure shown in FIG. 9A. Reference numeral 98 denotes a coupling threadedly engaged with the front end of the piston rod 66. The coupling 98 is integrally formed with a pair of plates 100*a* and 100*b* spaced in parallel relationship with each other. The head portion 50 of the rack 46*a* is inserted between the plates 100*a* and 100*b*. Each of the plates 100*a* and 100*b* has a pin insertion hole. A pin 102 is press-fitted with the pin insertion holes of the plates 100*a* and 100*b* and engaged with the engaging hole 56 of the rack 46*a*, thus connecting the piston rod 66 and the rack 46*a* through the coupling 98.

Each of the racks 46*a* to 46*d* has an arcuate projection 54 on the upper side opposite to the gear 52, and the projection 54 is in contact with the inner surface of the corresponding first guide gap 84 of the rack guide 82. Accordingly, each of the racks 46*a* to 46*d* is horizontally supported at three points, i.e., a first point of contact with the corresponding drive pinion 74, a second point of contact with the corresponding support pinion 78, and a third point of contact with the rack guide 82 at the projection 54. When each air cylinder 62 is operated, the corresponding one of the racks 46*a* to 46*d* is linearly reciprocated in the horizontal direction.

Figure 10:
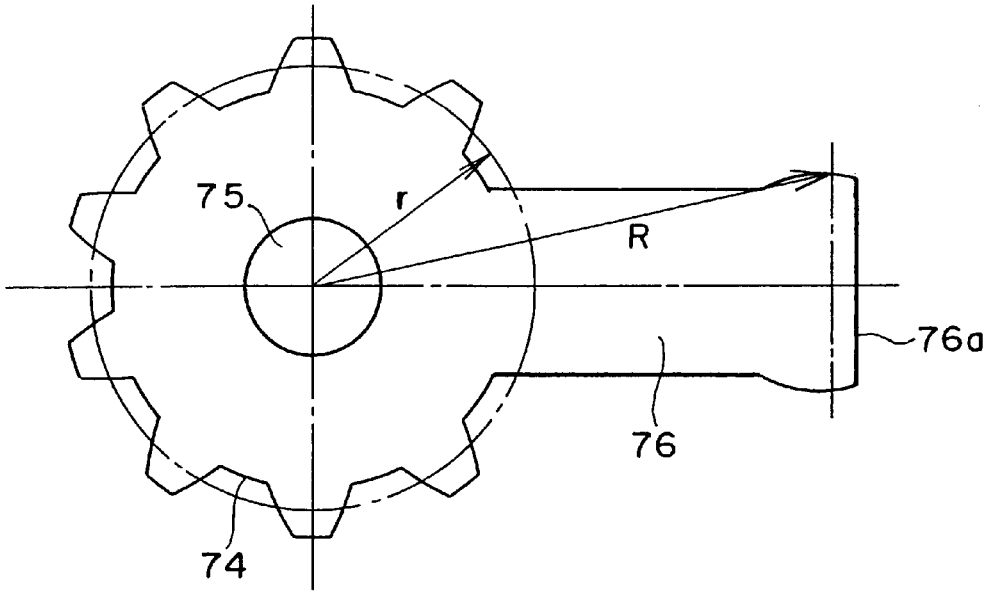
FIG. 10 is a side view for illustrating the transmission of torque by a drive pinion having a lever.
Figure 11:
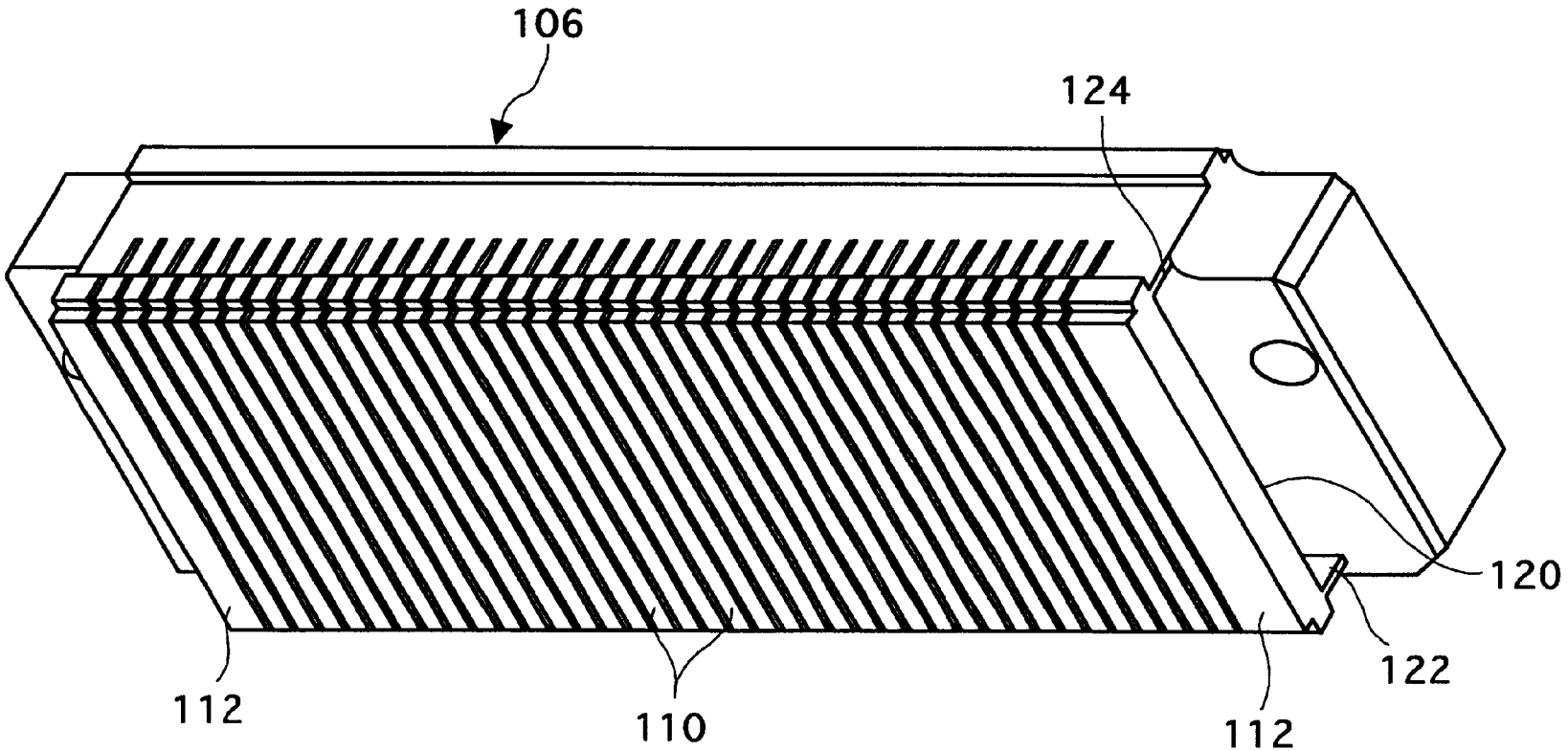
FIG. 11 is a perspective view of a row tool.
Figure 12:
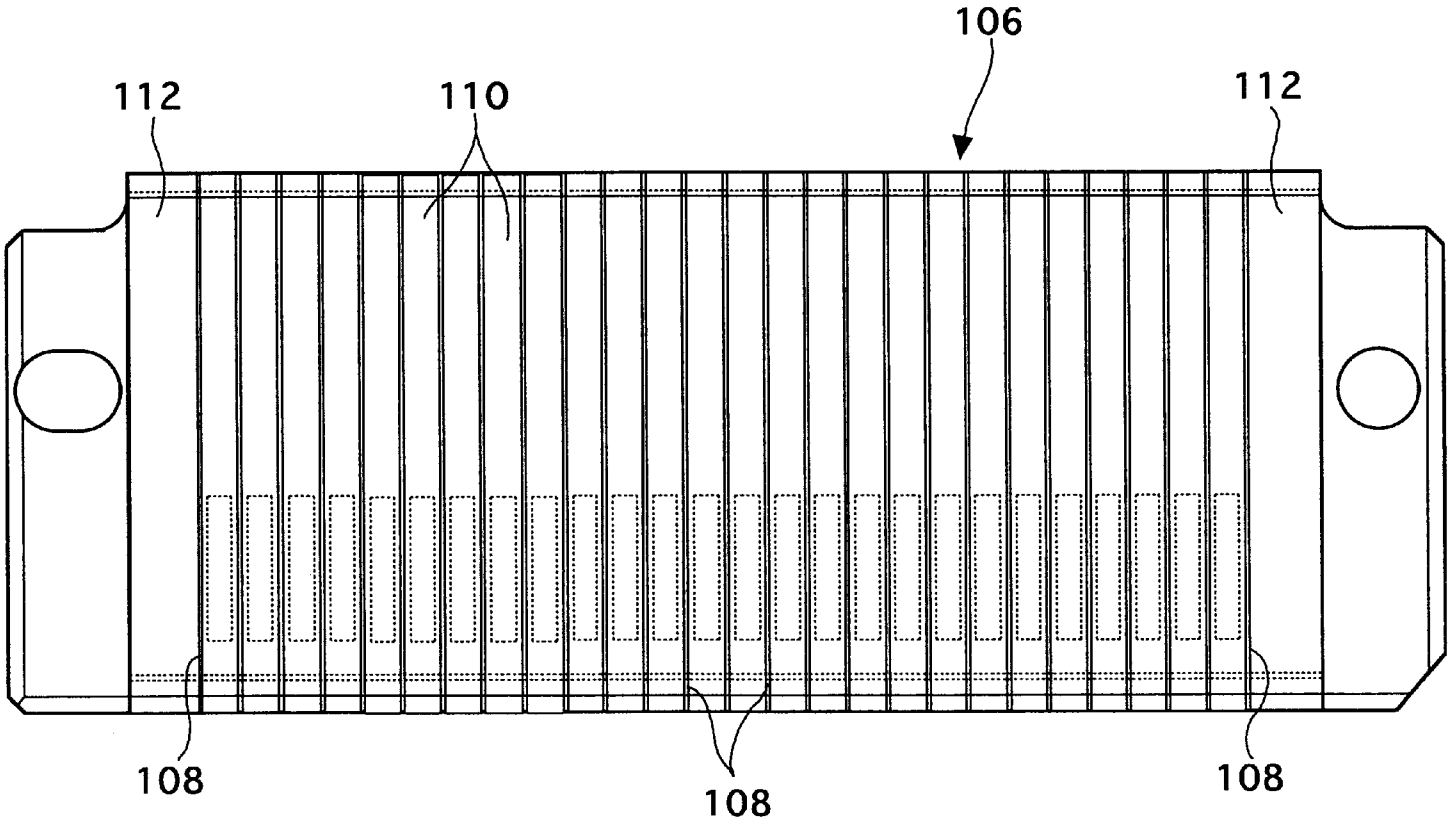
FIG. 12 is a front elevation of the row tool.
Figure 13:
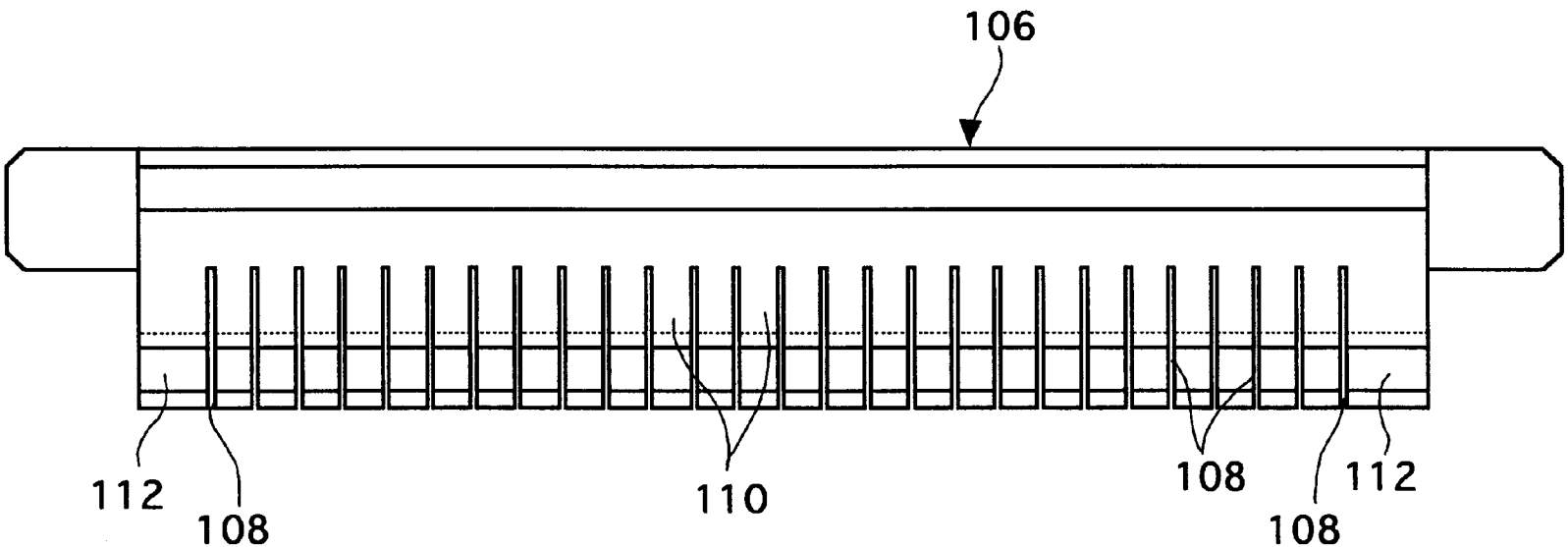
FIG. 13 is a plan view of the row tool.

The transmission of torque F at a front end portion 76*a* of the lever 76 of each drive pinion 74 will now be described with reference to FIG. 10. Letting $F_0$ denote the torque on the pitch circle of the drive pinion 74, the torque F at the front end portion 76*a* of the lever 76 is determined by the following equation because of no speed reducing mechanism.

$$F=F_0\times(r/R)$$

where r is the radius of the pitch circle of the drive pinion 74, and R is the distance from the center of the drive pinion 74 to a load point on the front end portion 76*a*. A standard spur gear is used for each of the racks 46*a* to 46*d* and each drive pinion 74, so that the torque transmission efficiency is about 100%.

There will now be described a row tool 106 fixed to the bend unit 80 shown in FIG. 6 for locally bending a row bar 126 (see FIG. 3) bonded to the lower end surface of the row tool 106 with reference to FIGS. 11 to 15. The row tool 106 includes a plurality of bend cells 110 for locally bending the row bar 126, and a pair of fixed cells 112 formed so as to interpose the bend cells 110. Each fixed cell 112 has a width larger than that of each bend cell 110. A slit 108 is defined between any adjacent ones of the bend cells 110 and a slit 108 is defined between each fixed cell 112 and the bend cell 110 adjacent thereto. Each slit 108 has a width of 0.1 mm.

Figure 15:
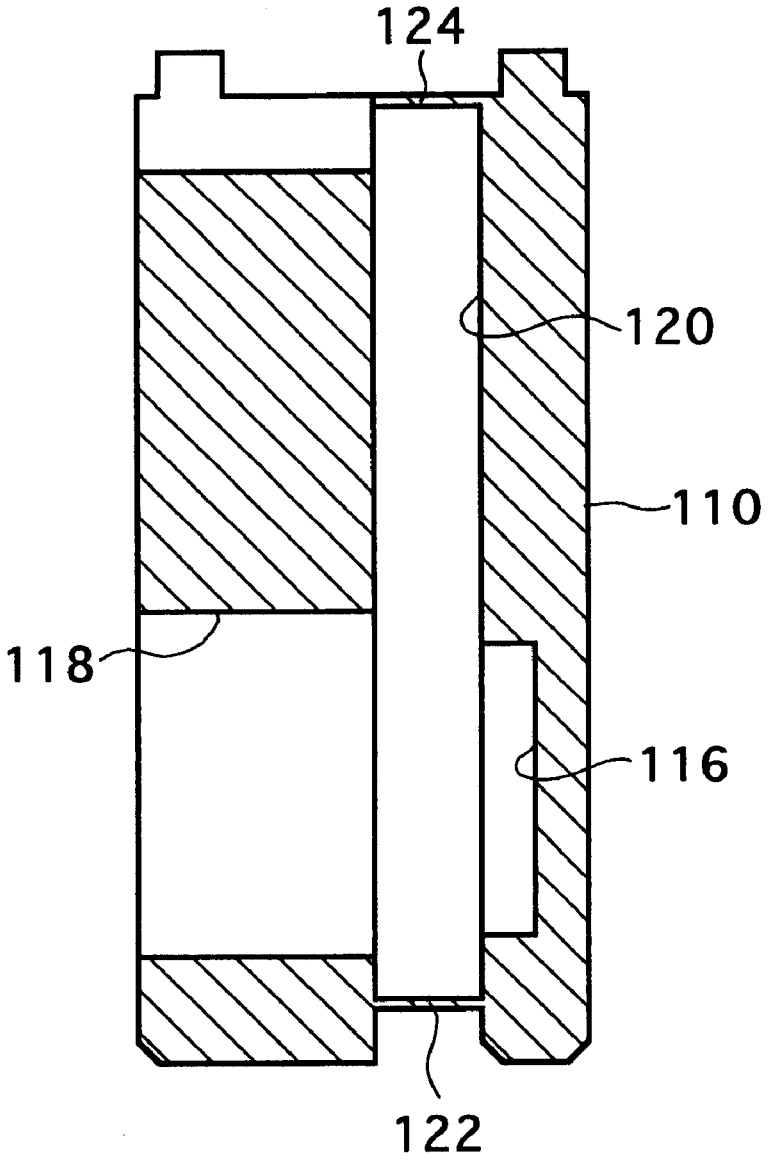
FIG. 15 is a cross section taken along the line XV—XV in FIG. 14.

As shown in FIGS. 3, 14, and 15, each bend cell 110 is formed with an engaging hole 116 for engaging the front end portion 76*a* of the corresponding lever 76. A through hole 120 is formed in the row tool 106 so as to horizontally extend from one end of the row tool 106 to the other end thereof, and a pair of spring portions 122 and 124 are formed at the lower and upper ends of the row tool 106, thereby forming a parallel spring mechanism for deformably supporting the bend cells 110. As best shown in FIG. 14, a horizontally elongated opening 118 is formed on the rear surface of the row tool 106 so as to communicate with the through hole 120 and the engaging holes 116. Thus, the front end portions 76*a* of all the levers 76 are engaged through the opening 118 and the through hole 120 into the engaging holes 116 of the bend cells 110.

When the front end portion 76*a* of each lever 76 is inserted in the corresponding engaging hole 116, there are defined upper and lower gaps between the front end portion 76*a* and upper and lower wall surfaces of the corresponding engaging hole 116. Each of the upper and lower gaps is about 0.1 mm. As shown in FIG. 3, the row bar 126 is bonded to the lower end surface of the row tool 106 by means of a hot-melt wax or adhesive with high accuracy. The row bar 126 is formed with a plurality of magnetic head elements arranged in a line. The row tool 106 is formed of stainless steel.

The bending operation of the row bar 126 will now be described with reference to FIG. 3. The compressed air supplied from the compressed air source 38 is introduced through the electro-pneumatic conversion regulator 42 into the head-side (push-side) chamber 63 or the rod-side (pull-side) chamber 65 of the double-acting air cylinder 62, thereby moving the piston rod 66 to the right or to the left as viewed in FIG. 3. By the movement of the piston rod 66, the rack 46*a* is moved to the right or to the left as viewed in FIG. 3. As a result, the drive pinion 74 is rotated clockwise or counterclockwise.

By the rotation of the drive pinion 74, the lever 76 engaged with the corresponding bend cell 110 of the row tool 106 is rotated to deform the corresponding bend cell 110 in the vertical direction. The amount of deformation of the bend cell 110 can be controlled by changing the pressure of the compressed air supplied to the double-acting air cylinder 62 in an analog fashion, so that an appropriate amount of deformation can be obtained in each bend cell 110. Accordingly, the row bar 126 can be minutely displaced with a fine pitch determined by the number of bend cells 110 (e.g., 28 bend cells 110 in this preferred embodiment), thereby realizing high-accuracy ELG lapping.

The row bar 126 is formed with a plurality of magnetic head elements and a plurality of ELG elements as resistance elements for monitoring the lapping. These head elements and ELG elements are arranged in a line. In lapping the row bar 126, a printed wiring board is bonded to the front surface of the row tool 106, and pads of the printed wiring board and terminals of the ELG elements are connected by wire bonding to measure a change in resistance of each ELG element.

A lapping pressure applied to the row bar 126 bonded to the row tool 106 during lapping is determined by the self-weight of the lap head 24 shown in FIG. 1 and the pressure applied to the lap head 24 by the pneumatic cylinders 32. In the case of rough lapping, this pressure is set to a high value, whereas in the case of finish lapping, this pressure is set to a low value. This pressure can be finely adjusted by operating the bend unit 80 to control a thrust applied to each bend cell 110.

According to the row bar lapping method and machine of the present invention, the displacement of the row bar at multiple points can be controlled, so that a target shape of the row bar can be easily obtained and high-accuracy lapping can be realized.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A lapping machine for lapping a row bar formed with a plurality of head elements arranged in a line, comprising:

a lap plate for providing a lapping surface;

a row tool having a plurality of bend cells formed by defining a plurality of slits;

a pressure mechanism for pressing said row tool toward said lapping surface of said lap plate; and a bend mechanism for bending said bend cells of said row tool toward said lapping surface of said lap plate;

said bend mechanism comprising:

an air cylinder unit having a plurality of double-acting air cylinders;

a plurality of racks operatively connected to said double-acting air cylinders, respectively;

a plurality of first pinions arranged coaxially and meshing with said racks, respectively, each of said first pinions being integrally formed with a lever;

a plurality of second pinions arranged coaxially and meshing with said racks, respectively, said second pinions being spaced apart from said first pinions;

a guide mechanism for guiding each of said racks, the respective first pinion, and the respective second pinion in substantially the same plane; and each of said bend cells of said row tool having an engaging hole for engaging a front end of each lever, whereby each lever engaged with said engaging hole is rotated to bend each bend cell of said row tool toward said lapping surface of said lap plate.

2. A lapping machine according to claim 1, wherein said bend mechanism further comprises:

a plurality of electro-pneumatic conversion regulators connected to said double-acting air cylinders, respectively; and a compressed air source connected to said electro-pneumatic conversion regulators.

3. A lapping machine according to claim 1, wherein said row tool further has:

first and second ends between which said bend cells are formed;

a pair of fixed cells formed at said first and second ends, each of said fixed cells having a width larger than that of each bend cell; and a parallel spring mechanism formed by defining a through hole extending from said first end to said second end.

4. A lapping machine according to claim 1, wherein said pressure mechanism comprises:

a lap head for applying a self-weight to said row bar to press said row bar on said lapping surface; and a pressure cylinder for applying an adjustable pressure to said lap head.

5. A lapping machine according to claim 1, wherein:

said guide mechanism includes a rack guide having a plurality of guide gaps for guiding said racks, respectively;

each of said racks has a first surface formed with a gear and a second surface formed with a projection opposite to said first surface, said projection being in contact with said rack guide; and each of said racks is supported at a first point of contact with said respective first pinion, a second point of contact with said respective second pinion, and a third point of contact with said rack guide at said projection, whereby each rack is linearly reciprocated in a horizontal direction.

6. A lapping machine according to claim 1, wherein the thicknesses of each rack, each first pinion, and each second pinion are set in the range of ¼ to ½ of the pitch of said bend cells.

7. A lapping machine according to claim 1, wherein the gear module of each rack, each first pinion, and each second pinion is set to ½ or less of the pitch of said bend cells.

8. A bend mechanism for locally bending a row bar formed with a plurality of head elements arranged in a line, comprising:

a plurality of racks arranged in a direction perpendicular to a direction of movement of said racks; and a plurality of first pinions arranged coaxially and meshing with said racks, respectively, each of said first pinions being integrally formed with a lever.

9. A bend mechanism according to claim 8, further comprising:

an air cylinder unit having a plurality of double-acting air cylinders, each of said double-acting air cylinders having a piston and a piston rod connected to said piston;

a plurality of second pinions arranged coaxially and meshing with said racks, respectively, said second pinions being spaced apart from said first pinions;

a guide mechanism for guiding each of said racks, the respective first pinion, and the respective second pinion in substantially the same plane; and said racks being connected to said piston rods of said double-acting air cylinders, respectively.

10. A bend mechanism according to claim 9, wherein:

said guide mechanism includes a rack guide having a plurality of first guide gaps, and a pinion guide having a plurality of second guide gaps;

said racks being guided in said first guide gaps of said rack guide, respectively; and said first and second pinions being guided in said second guide gaps of said pinion guide, respectively.

11. A lapping method for lapping a row bar formed with a plurality of head elements arranged in a line, comprising the steps of:

providing a lapping surface by a lap plate;

bonding said row bar to a lower surface of a row tool having a plurality of bend cells formed by defining a plurality of slits;

pressing said row bar on said lapping surface; and operating a bend mechanism including an air cylinder unit having a plurality of double-acting air cylinders, a plurality of racks operatively connected to said double-acting air cylinders, respectively, and a plurality of pinions arranged coaxially and meshing with said racks, respectively, each of said pinions being integrally formed with a lever, thereby applying an adjustable bending pressure to each of said bend cells;

whereby said row bar is bent at a plurality of points to perform lapping of said row bar.

12. A row tool to which a row bar formed with a plurality of head elements arranged in a line is to be bonded, comprising:

a plurality of bend cells formed by defining a plurality of slits, each of said bend cells having an engaging hole;

first and second ends between which said bend cells are formed;

a pair of fixed cells formed at said first and second ends, each of said fixed cells having a width larger than that of each bend cell; and a parallel spring mechanism formed by defining a through hole extending from said first end to said second end.

* * * * *